United States Patent [19]

Lemke

[11] 4,340,338

[45] Jul. 20, 1982

[54] HYDRAULIC PRESSURE BIASED LINEAR MOTION THRUST BLOCK FOR HYDRAULIC PUMPS AND MOTORS

[75] Inventor: Gregory D. Lemke, Racine, Wis.

[73] Assignee: Rexnord Inc., Milwaukee, Wis.

[21] Appl. No.: 159,015

[22] Filed: Jun. 13, 1980

Related U.S. Application Data

[62] Division of Ser. No. 884,924, Mar. 9, 1978, Pat. No. 4,222,718.

[51] Int. Cl.[3] ..... F03C 2/00; F04C 15/04

[52] U.S. Cl. ..... 418/26; 418/31

[58] Field of Search ..... 418/24–27, 418/30, 31

[56] References Cited

U.S. PATENT DOCUMENTS

| | | | |
|---|---|---|---|
| 1,988,213 | 1/1935 | Ott | 418/31 |
| 2,600,633 | 6/1952 | French | 418/26 |
| 2,764,941 | 10/1956 | Miller et al. | 418/26 |
| 3,052,189 | 9/1962 | Head | 418/27 |
| 3,134,334 | 5/1964 | Smith | 418/31 |
| 3,137,235 | 6/1964 | Brown | 418/22 |
| 3,523,746 | 8/1970 | Dadian et al. | 418/26 |
| 3,901,628 | 8/1975 | Bornholt et al. | 417/310 |
| 3,918,855 | 11/1975 | Bornholt | 418/24 |

*Primary Examiner*—John J. Vrablik

*Attorney, Agent, or Firm*—Aaron L. Hardt; Vance A. Smith

[57] ABSTRACT

The casing of a pump defines a threaded hole into which is inserted an outer block for reacting radially directed forces transmitted by a second inner block from a movable, pressurized cam ring surrounding the pump rotor. The blocks have mutually parallel mating surfaces arranged generally tangential to the ring. Onto one of such surfaces is bonded an anti-friction bearing material, such as a woven fabric or metal, to facilitate sliding action between them. The eccentric position of the cam ring is partly established by the action of system pressure acting on control pistons while the guided motion of the inner block further positions the ring to optimal adjustments made to the outer block.

8 Claims, 4 Drawing Figures

Fig. 3
PRIOR ART
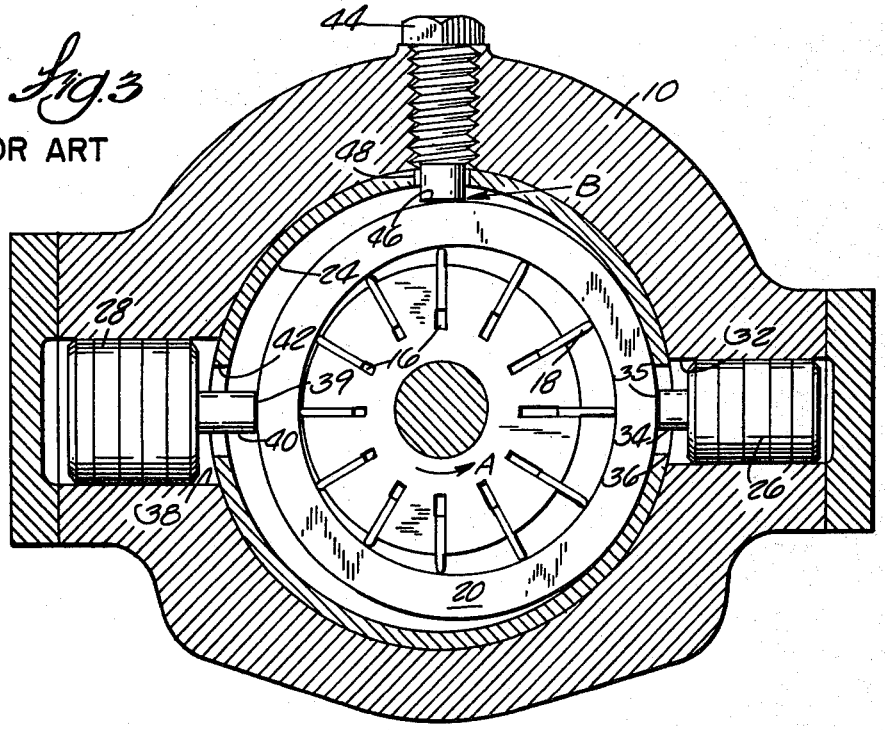
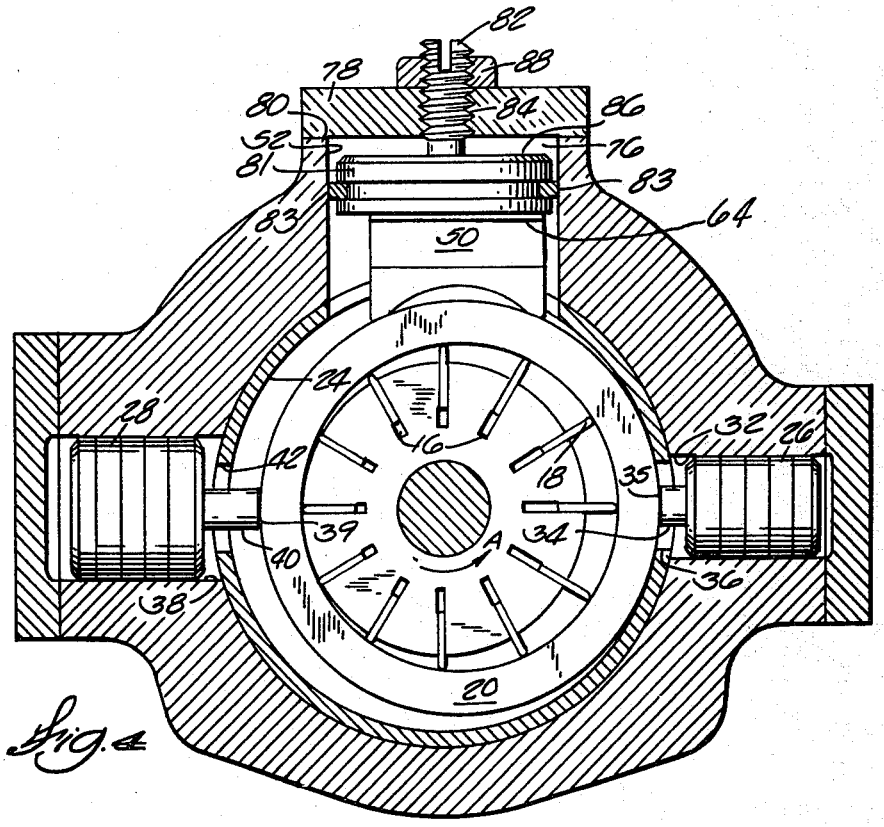
Fig. 4

HYDRAULIC PRESSURE BIASED LINEAR MOTION THRUST BLOCK FOR HYDRAULIC PUMPS AND MOTORS

This is a division, of application Ser. No. 884,924, filed Mar. 9, 1978, now U.S. Pat. No. 4,222,718.

BACKGROUND OF THE INVENTION

1. Field of the Invention

This invention relates to an assembly for control of the position of the cam ring of hydraulic pumps and motors and in particular for hydraulic pumps having system pressure actuated control pistons for regulating cam ring eccentricity and for pumps wherein the cam ring eccentricity is determined by the action of mechanical springs and other biasing means.

2. Description of the Prior Art

Variable volume vane pumps typically have radially directed, diametrically opposed, pressure actuated pistons for regulating the position of a movable cam ring in response to pump operating pressure conditions. Pumps of this type also regulate cam ring positioning by the action of a single, radial, spring-loaded piston or by a single pressure actuated piston, either of which similarly oppose pressure related cam ring forces. A net unbalanced force is applied radially to the cam ring, a result of the asymmetry of the pump pressure distribution within the pump chamber which is bonded circumferentially by the cam ring. This force is balanced on the ring by the bearing reaction produced by a thrust screw or thrust block assembly that applies an oppositely directed radial reaction to the outer periphery of the ring.

Various methods have been employed to restrain the cam ring with a view to providing the kind and sufficiency of cam ring motion as is required for efficient pump operation.

The requisite ring motion is cyclic in nature. Pump pressure continually produces the radial thrust forces referred to above, and, in one known method, develops frictional forces at the point where the control pistons bear on the movable cam ring. These friction-related forces are known to cause piston wear as well as excessive wear at the pump casing bore into which the pistons fit.

In addition, accurate pump control is considerably hampered by friction on the pistons because ring motion, then, is not smooth and continuous in response to control piston input. It is, instead, random and incremental as static friction is first developed, then overcome to allow ring motion, and later becomes static again. This phenomenon, referred to as slip-stick friction is responsible for the retarded effect of control piston action and results in control less positive and predictable than if friction were absent.

The chafing at the pump case bore eventually produces clearances between the control and bias pistons and the bore. The pistons are exposed to high pressure levels and since leakage varies as the cube of the clearance, the pump become exponentially less efficient as wear clearance accrues. This problem is particularly troublesome in vane pumps where the fretting action between cam ring and control pistons is a result of high cyclic loads applied at high frequency.

The following U.S. patents bearing on the subject matter of this invention are known: U.S. Pat. Nos. 3,052,189; 3,523,746; 2,600,633; 3,137,235, 3,918,855 and 3,901,628.

These patents disclose constant and variable volume vane pumps having several means for control of cam ring position. Essentially three distinct methods are shown to provide a reaction to the radial thrust force which fluid pressure produces on the cam ring: a thrust screw; a pivoting or articulating ball joint and a roller or needle bearing support. In each known method of thrust block reaction, an inner member is maintained in contact with the movable cam ring on its outer periphery as the ring moves in response to pump operating conditions.

The thrust screw approach permits the cam ring to roll on the flat inner surface of the screw as piston forces produce motion which is eccentric of the rotor center. This rolling causes relative motion between the control pistons, which are stationary in the circumferential sense, and the cam ring.

A ball joint may replace the static reaction of the thrust screw. In this technique two blocks are provided; an inner block which maintains cam ring contact and an outer block fixed to the pump casing. A ball bearing is positioned in a suitable surface for its retention between the blocks and permits the inner block to pivot about the bearing axis as the cam ring, moving eccentrically in response to system pressure effects, rotates. There is, again, considerable relative motion which produces friction at the axially loaded control piston—cam ring interface.

A third type of thrust reaction is provided by using a similar arrangement of inner and outer blocks, but with a series of roller or needle bearings in the space provided for their retention. The inner block continually maintains cam ring contact and moves by translation as the ring eccentricity varies in response to control piston forces. Here, the needle bearings preclude rotation and allow sliding action only between the blocks. Thrust reaction magnitudes are generally so large and are applied to bearing surfaces, viz, the needle—block interfaces, which are so small, that excessive contact stresses produce operating lives that are unacceptably short.

SUMMARY OF THE INVENTION

The invention herein disclosed and claimed achieves a number of specific objects which eliminate or minimize current problems present in hydraulic pump and motor technology by a simplification in thrust block configuration. It has been found that problems relating to pump wear, hysteresis, noise and efficiency can be corrected by changing the nature of the motion allowed to occur where the thrust block contacts the movable cam or regulator ring.

Among the inventive objects, stated with reference to the technology as currently practiced, include:

1. elimination of the cyclic relative motion between the cam ring and the control and bias pistons;
2. elimination of the cam ring eccentricity changes during a discrete flow condition;
3. reduction of hysteresis particularly at the point of piston contact with the cam ring and at the location of the thrust block-cam ring reaction;
4. an easily adjustable thrust block capable of external access without need of pump disassembly;
5. minimizing pump noise by regulation of thrust block positioning during operating conditions;
6. optimal reduction of thrust reaction forces as a result of setting thrust block positioning during operation; and 7. increased pump efficiency by elimination of wear induced leakage.

A two-part thrust block assembly, the inner block of which has its planar mating surfaces bonded with an anti-friction material, is held in continual contact with the cam ring and allows a sliding motion between them, in contradistinction to a pivoting or a combined pivoting-sliding motion. Another embodiment incorporates the inner thrust block with the cam ring to provide a unitary assembly that operates together with an outer, adjustable block to accomplish the objectives and avoid the difficulties which attend current practice. A further modification illustrates a third embodiment having a capacity to facilitate the positioning of the externally adjustable outer block during high pressure conditions.

BRIEF DESCRIPTION OF THE DRAWINGS

FIG. 3 is an elevation section of a prior art thrust reaction technique taken as in FIG. 1.

FIG. 4 is an elevation section of a pressure assisted embodiment taken as in FIG. 1.

DETAILED DESCRIPTION OF THE PREFERRED EMBODIMENT

The linear motion thrust block which is described and claimed herein can be applied to a broad range of variable volume hydraulic pumps and motors wherein the cam or regulator ring varies in position from concentricity with the rotor to an extreme eccentric position. Certain types of pumps and motors having invariant volume capability do not require a range of cam ring travel but are equally well suited to apply the advantages of this invention. The detailed description which follows, having exclusive reference to equipment of the former type, more fully describes the manner of its use particularly in respect to the kinematic requirements.

Figure 2:
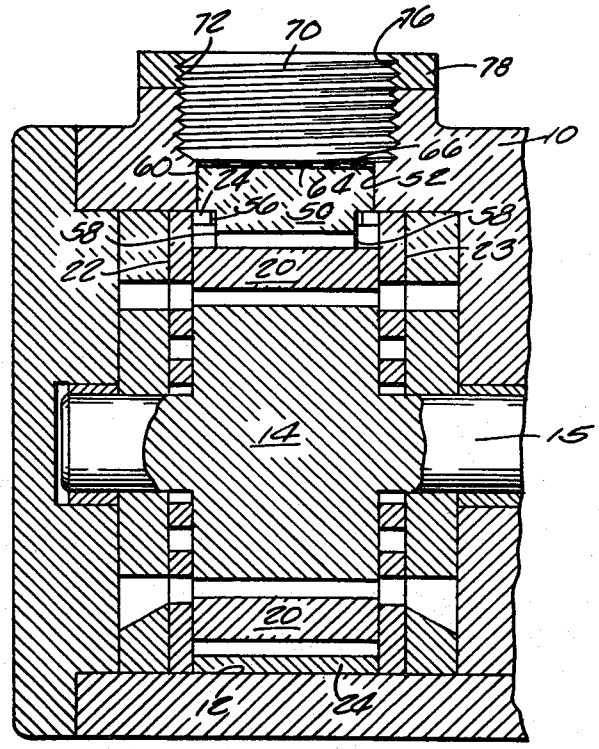
FIG. 2 is an elevation section of the pump taken through the plane 2—2 as shown in FIG. 1.
Figure 1:
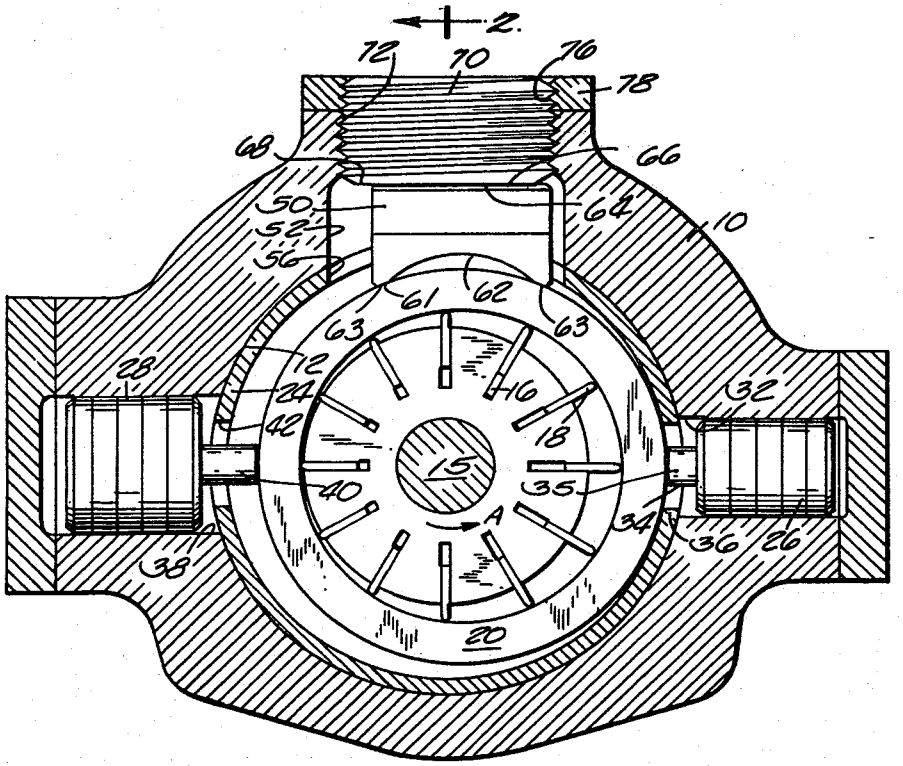
FIG. 1 is an elevation section of a variable volume vane pump taken normal to the shaft axis and through the cam ring.

Variable volume vane pumps, as shown in FIGS. 1 and 2, are generally constructed with a two-part casing 10 into one of which is machined a cylindrical chamber 12 for receiving the pumping elements, the other casing part serving to close off the chamber.

The pumping elements include a rotor 14, whose direction of rotation is as indicated throughout by the vector A, having a series of outwardly extending slots 16, each of which receives an outwardly movable vane 18 capable of radial movement within the slot outwardly under the action of centrifugal force and usually system pressure to the extent the movement is controlled by a movable cam ring 20.

The rotor 14 is rotatably mounted on a shaft 15 that is suitably fit at its ends in bearings which are received in openings in the casing parts for this purpose.

In order to form closed pumping spaces between adjacent vanes 18 and the cam ring 20, the sides of the spaces are closed off by a pair of pressure plates 22 and 23 positioned in the chamber 12 at opposite sides of the rotor 14. Leakage at this interface is reduced by the use of seals and the preloaded contact produced by pump pressure tending to urge the plates 22 and 23 inwardly toward the rotor 14.

It is important to limit the pressure of the plates against the rotor and cam ring in order to minimize wear on the inner face of the plates resulting from rotation of the rotor and to prevent binding of the movable cam ring which must vary its position to provide the variable volume control to the pump. This result is sometimes accomplished by the use of a spacer ring 24 positioned between the pressure plates 22 and 23 surrounding the cam ring 20.

The movable cam ring 20 is regulated in its positioning relative to the rotor axis to control the pump output by hydraulic or mechanical means which may include a pair of diametrically opposed hydraulic pistons 26 and 28 engaging the outer surface of the cam ring 20.

A net unbalanced radial force is developed in the pumping chambers defined by adjacent vanes 18, the rotor 14; the pressure plates 22, 23 and the cam ring 20. The force, a product of the pump chamber pressures and the area on which it acts, as applied to the cam ring, is outwardly directed and aligned with the axis of a thrust block assembly installed in the casing walls.

The piston 26 is movable in a bore 32 in the casing part and has an operative end 34 extending through an opening 36 in the spacer ring 24 to engage the cam ring outer surface. The piston 26 is continually subjected to the pump output pressure and will urge the cam ring 20 away from the eccentric position shown in FIG. 1 and toward a concentric position relative to the rotor 14 to thereby reduce the volume of the pump output.

Cam ring positioning is further determined by the action of piston 28 acting in opposition to piston 26. Piston 28 is movable in a bore 38 formed in the casing and has a reduced end 40 extending through an opening 42 in the spacer ring 24 to engage the outer surface of the cam ring 20. The piston chamber 38 is generally exposed to a pressure compensating servo valve which may be operative or not depending on actual pump pressure operating conditions and a predetermined threshold at which compensation initiates. When the servo is not pressure compensating, chambers 32, 38 and piston 26, 28 are subjected to outlet fluid pressure in which case piston 28 urges the ring 20 to the right since its area, and consequently the force applied, are about twice that of piston 26. As pressure increases and compensation initiates, fluid is drained from piston 28 and chamber 38. Cam ring 29 is then controlled solely by the action of piston 26 and assumes a position concentric with the rotor axis.

Before describing the structure and operation of the thrust block, which is the subject matter of the invention, the geometric relationships attending the motions associated with known thrust force reaction techniques and restraint are set out. This is best done with reference to FIG. 3 where is shown an example of a conventional means for thrust load reaction. This arrangement includes a thrust bolt 44 threaded into the casing 10 and having a lower end 46 extending through an opening 48 in the spacer ring 24 to support the cam ring 20 against the thrust force.

The extremities of cam ring motion are, at the low volume end, fully concentric with the rotor 14 and, at the high volume end, at the maximum eccentricity permitted, as when the cam ring 20 abuts the spacer ring 24. Between these extremes, as outlet pressure varies in excess of and short of the compensating pressure at which piston 26 predominates to influence cam ring positioning, the cam ring will cycle eccentrically of the pump axis and generally along the line defined by the axes of pistons 26 and 28. As this continual, iterative correction process automatically proceeds, the thrust bolt 44 is required to maintain contact with the cam ring by the action of the radial thrust force whose line of action is approximately perpendicular to the axes of pistons 26, 28. It has been found in this method for applying the thrust reaction, that the ring 20 will roll on the surface 46 formed at the end of the thrust bolt 44 where ring contact is forced to occur as the ring varies its eccentric position in response to piston pressure conditions.

The relative magnitudes and directions of the forces involved with the control and bias pistons 26 and 28, in relation to the thrust force, explains the rolling motion, as does the requisite kinematics. When piston 28 operates to increase cam ring eccentricity, the peak force it applies to the ring 20 is approximately half that of the thrust force. A frictional force is developed on the ring at the thrust bolt 44-cam ring 20 interface, as indicated by vector B, tending to prevent eccentric cam ring motion, directed opposite the control force in piston 28 and, of course, is unaligned with the piston force. This friction force and the axial force on piston 28 combine to produce a couple on the ring 20 tending to revolve the ring cyclically about the contact point on the interface surface 46.

The oscillatory motion of the ring 20, rolling within the cylindrical chamber 12, operates to produce wear on the surfaces 35 and 39 of the pistons 26 and 28, and, by way of the pistons, on the walls of the bores 32 and 38 into which they fit. The wear ultimately produces sufficient clearances to allow hydraulic fluid to leak between the bore and piston, which leakage progressively reduces pump efficiency. The friction forces that develop on surfaces 35 and 39 additionally prevent smooth and continuous ring 20 motion in response to control and bias piston 26,28 interaction. They require greater amounts of piston forces to produce the same motion and dissipate control energy input, further decreasing operating efficiency.

An unillustrated configuration using ball bearings fitted in a thrust block to provide an efficient surface on which the bearing rotation may occur, is a known method of providing the thrust reaction in a way which reduces energy dissipation from that of the thrust bolt technique. The lateral excursions of the ring cause the thrust block to rotate at the bearing in such a way that the block and the ring will remain in contact as the distance on the vertical axis between the rotor center and cam ring periphery varies in response to piston actuation. This approach does little to alleviate wear problems since ring motion is comparatively unchanged, the associated hysteresis continues, and leakage increases while pump or motor service time accrues.

The invention, next to be described and claimed, alters substantially the nature of the ring 20 motions by limiting the degrees of freedom possible to it and by providing a particular guided path to which the movement must conform. A follower 50, as shown in FIGS. 1 and 2, fits within an opening 52 in the pump casing 10 and engages the outer surface of the cam ring 20 by extending through a clearance opening 56 formed in the spacer ring 24. The follower has recesses 58 on its cylindrical surface 60 sized to produce a net thickness somewhat less than that of the spacer ring 24 and deep enough to produce a net thickness section sufficiently long to extend within the spacer ring opening 56. The inner surface 61 has a concave shape with a radius of curvature about equal to the outer radius of ring 20. Surface 61 is preferably intersected by a surface 62, which may have a greater curvature than 61, but, in any case, produces two discrete surfaces 63 at the lateral ends of the follower 50. Follower contact with the cam ring, in this way, is produced at the surfaces 63 only, and has been found to reduce frictional losses from what would otherwise result if the entire inner surface 61 were to be the contacting area.

The outer surface 64 is planar and situated parallel to a horizontal tangent drawn through the apex of the cam ring 20 when in position coincident with the rotor axis. On the surface 64 is bonded an antifriction material 66, preferably a woven, TEFLON impregnated fabric, for example, REXLON, which, by contacting a similarly positioned, but unbonded, inner surface 68 on an adjustable block 70, provides a reduced, friction-retarded motion between them. Other anti-friction bearing materials, such as aluminum or bronze can be applied to surface 64 to produce the desired results.

The adjustable block 70 has threads 72 formed on its cylindrical outer surface which engage matching threads formed on a bore 76 in the pump case 10. A locking nut 78, or any other suitable means, may be used to secure the block 70 in place within the casing once its optimal location is determined.

Adjustment of the ring 20 positioning to optimize noise tuning and internal pump forces can be easily accomplished by varying the depth to which the adjustable block 70 is threaded into the casing. The thrust block configuration of this invention allows the follower 50 to slide on the mating surfaces 64 and 68, and so the distance from those surfaces to the ring 20 is invariably defined by the thickness of follower 50.

An unillustrated embodiment combines the cam ring 20 and the follower 50 in a unitary construction having a planar surface 64 for slidable motion on a mating surface 68 of the adjustable block 70. The surface 64 has the TEFLON base, anti-friction fabric material 66 bonded as previously described to reduce the retarding effect to sliding motion which friction produces. Other than by combining the follower and ring in a single element, FIGS. 1 and 2 sufficiently illustrate this embodiment and the foregoing description presents its function.

A third embodiment shown in FIG. 4 provides for hydraulic system pressure to be applied to a sealed chamber 76 defined by an opening 52 in the casing 10, a cap 78 fixedly attached to the casing outer surface 80 and an adjustable block 81 fitted within the opening 52, being capable of axial movement and having a seal 83. An adjusting screw 82 abutting the adjustable block 81 and engaging internal threads 84 formed in the cap 78 is capable of externally varying the radial position of the block 81 and the follower 50. On surface 64 of follower 50 is bonded an anti-friction material. Pressure in the chamber 76 is applied to the outer surface 86 of the block 81 and produces an inwardly directed radial force tending to unload the adjusting screw 82 against the effects of outwardly directed thrusts forces, thereby facilitating adjustments made to block 81 positioning during operating conditions. Its operation is otherwise identical to that previously described. A jam nut 88, or another suitable means to prevent motion of the adjusting screw 82 following its optimal setting, can be used.

I claim:

1. A thrust block assembly for a hydraulic pump or motor having a casing defining a chamber for receiving a rotor and a cam ring surrounding said rotor, said cam ring radially movable relative to the axis of said rotor in response to pressures generated within said pump or motor during the operation thereof, said casing further including a bore therethrough into said chamber, said bore being in fluid communication near its outer end with the hydraulic system pressure of said pump or motor, said thrust block assembly comprising:

an outer block having an outer perimeter substantially identical to the perimeter of said bore and a planar, inner surface positioned generally parallel to a plane tangential to said rotor, said outer block freely disposed along the axis thereof in said bore and radially adjustable relative to said rotor axis during the operation of said pump or motor, adjusting means separate from said outer block for adjusting the radial position of said outer block relative to said rotor axis, said adjusting means attached to said casing to close said bore at its outer end and provide a threadably mounted portion having an outer end external to said pump or motor for rotation thereof during the operation of said pump or motor and an inner end disposed within said bore a distance determined by said external rotation of said threadably mounted portion in juxtaposition to said outer block, said inner end of said threadably mounted portion having an outer perimeter substantially less than the perimeter of said bore, seal means carried by said outer block to form a sealed pressure chamber in fluid communication with the hydraulic system pressure of said pump or motor within said bore between said outer block and said adjusting means, whereby hydraulic pressure is created between said adjusting means and said outer block during the operation of said pump or motor tending to separate said adjusting means and said outer block and facilitate said radial adjustment of said outer block during the operation of said pump or motor, an inner block freely movable within said bore and interposed between said outer block and cam ring, said inner block having a planar, outer surface positioned generally parallel to a plane tangential to said rotor determined by said radial adjustment of said outer block and in sliding contact with said inner surface of said outer block and having an inner surface in contact adjustable during the operation of said pump or motor with the outer periphery of said cam ring to position said cam ring relative to said rotor axis in the directions parallel to the axis of said outer block, so that substantial movement of said cam ring relative to said rotor axis during the operation of said pump or motor is prevented in the direction of said thrust block by said contact between said inner block and cam ring and facilitated in the directions parallel to said planar surfaces of said inner and outer blocks by said sliding contact therebetween enabling said inner block to slide across said outer block when said cam ring moves in said parallel directions, and a substantially planar layer of antifriction material bonded to one of said planar surfaces of said inner and outer blocks to reduce the retarding effect on said sliding contact that friction would produce.

2. The thrust block assembly of claim 1, wherein said adjusting means is fixed in relation to said casing at an adjusted radial position by thread locking means.

3. The thrust block assembly of claim 1, wherein said layer of anti-friction material is bonded to said outer surface of said inner block.

4. The thrust block assembly of claim 1, wherein said layer of anti-friction material is a woven fabric.

5. The thrust block assembly of claim 1, wherein said layer of anti-friction material is aluminum.

6. The thrust block assembly of claim 1, wherein said layer of anti-friction material is bronze.

7. The thrust block assembly of claim 1, wherein said inner surface of said inner block has discrete surfaces located at the lateral ends thereof which provide areas for said contact of said inner block and cam ring.

8. The thrust block assembly of claim 1, wherein said adjsting means comprises a casing cover mounted on said casing and having an internal screw thread therethrough, a set screw engaging said threads of said casing cover and thread locking means for fixing said set screw relative to said casing cover.

* * * * *